US010815085B2

(12) United States Patent
Haug

(10) Patent No.: US 10,815,085 B2
(45) Date of Patent: Oct. 27, 2020

(54) DEVICE FOR PRINTING PACKAGES WHICH ARE FED INDIVIDUALLY TO A PRINTING UNIT

(71) Applicant: FRAMA AG, Lauperswil (CH)

(72) Inventor: Thomas Peter Haug, Bern (CH)

(73) Assignee: FRAMA AG, Lauperswil (CH)

( * ) Notice: Subject to any disclaimer, the term of this patent is extended or adjusted under 35 U.S.C. 154(b) by 0 days.

(21) Appl. No.: 16/058,132

(22) Filed: Aug. 8, 2018

(65) Prior Publication Data

US 2019/0152731 A1 May 23, 2019

(30) Foreign Application Priority Data

Nov. 22, 2017 (EP) ..... 17405031

(51) Int. Cl.

| | |
|---|---|
| ***B65H 5/02*** | (2006.01) |
| ***B41J 11/00*** | (2006.01) |
| ***B41J 11/20*** | (2006.01) |
| ***B41J 13/12*** | (2006.01) |

(52) U.S. Cl.

CPC ..... *B65H 5/026* (2013.01); *B41J 11/007* (2013.01); *B41J 11/20* (2013.01); *B41J 13/12* (2013.01); *B65H 5/025* (2013.01)

(58) Field of Classification Search

CPC . B65H 5/026; B41J 13/12; B41J 11/20; B41J 11/007; B65G 39/10

USPC ..... 198/861.2, 861.3, 814, 837, 842

See application file for complete search history.

(56) References Cited

U.S. PATENT DOCUMENTS

| | | | | |
|---|---|---|---|---|
| 5,913,627 | A * | 6/1999 | Freeman | B41J 11/005 400/630 |
| 6,019,526 | A * | 2/2000 | Herbert | B41J 11/20 400/58 |
| 7,611,141 | B2 * | 11/2009 | Williams | G07B 17/00467 198/626.4 |
| 7,976,010 | B2 * | 7/2011 | Grogor | B65H 3/045 271/121 |
| 8,341,094 | B2 | 12/2012 | Haug | |
| 2008/0211168 | A1 * | 9/2008 | Kutzer | B65H 3/045 271/18 |
| 2013/0256099 | A1 * | 10/2013 | Aposhian | A01G 20/15 198/837 |

FOREIGN PATENT DOCUMENTS

| | | |
|---|---|---|
| EP | 0705707 A1 | 4/1996 |
| EP | 1183154 B1 | 8/2004 |

* cited by examiner

*Primary Examiner* — Patrick Cicchino

(74) *Attorney, Agent, or Firm* — Lucas & Mercanti, LLP; Klaus P. Stoffel

(57) ABSTRACT

A device for printing flat packages fed individually to a printing unit of a franking machine, pass the printing unit on one side and are guided on a side edge in the conveying direction, including a conveying apparatus which grips the packages at a front end and, by a guide plate forms a conveying plane of a conveying gap with an opposite conveying unit of the conveying apparatus. In the conveying direction, the conveying unit has two endless drawing devices next to each other which circulate a common axle on deflecting rollers, and the upper run of which, and the lower run of which are guided on running rollers mounted freely rotatably in pairs so as to lie opposite one another at pivotable ends of double lever arms assigned to the upper and the lower run, and supported on the inner side of the runs by spring force.

15 Claims, 4 Drawing Sheets

DEVICE FOR PRINTING PACKAGES WHICH ARE FED INDIVIDUALLY TO A PRINTING UNIT

CROSS-REFERENCE TO RELATED APPLICATIONS

The present application claims priority of 17 405 031.0, filed Nov. 22, 2017, the priority of this application is hereby claimed and this application is incorporated herein by reference.

BACKGROUND OF THE INVENTION

The invention relates to a device for printing fiat packages which are fed individually to a printing unit of a franking machine, pass the printing unit on at least one of the fiat sides in a manner which is driven in a frictionally locking manner, and are guided on a side edge in the conveying direction F, such as envelopes, mailing bags, covers, cards, printed products or the like, consisting of a conveying apparatus which grips the packages at a front end in the conveying direction F and, by way of a guide plate which is arranged on the underside of the printing unit, forms a conveying plane of a conveying channel with an opposite conveying unit of the conveying apparatus.

EP 1 183 154 B1 describes a franking machine having at least one print head of a printing unit for printing flat packaged objects which can be inserted or run through, such as closed envelopes and postcards, which franking machine consists a guide part which projects around the print head and with respect to the opening plane of the latter, which guide part is assigned a conveying device which transports the packaged objects between them and opposite conveying rollers, which rotate about an axles arranged transversely with respect to the conveying direction, of a the packaged objects, the conveying device having two drive-connected drive rollers which form a conveying section with the guide part and are arranged in front of and behind the print head as viewed in the conveying direction, and in each case one reversible counterpressure roller is provided in a manner which lies opposite, which counterpressure roller exerts a pressure against a drive roller or a packaged object which is gripped in between. Conveying devices of this type require high structural precision and precise coordination of the conveying rollers and the drive elements among one another, the drive friction being interrupted between the conveying rollers, with the result that irregularities with regard to the position and the stability of the packaged objects can arise which lead to imprecise printed images and impair the control.

SUMMARY OF THE INVENTION

The present invention has been set the object of providing a device for printing packages which are fed individually to a printing unit of a franking machine, which device is distinguished by a simple construction for a reliable method of operation with proven machine elements and components and proves to be easy to use and easy to service.

According to the invention, the object is achieved by virtue of the fact that, as viewed in the conveying direction (F) of the packages, the conveying unit has at least two endless drawing means at a distance next to each other which in each case circulate a common axle on deflecting rollers, and the upper run of which, which faces the guide plate, and the lower run of which are guided on running rollers which are mounted freely rotatably in each case in pairs so as to lie opposite one another at pivotable ends of one of a plurality of double levers of the conveying unit which are assigned to the upper and the lower run, respectively, of the drawing means and are formed from angled-away lever arms, and are supported on the inner side of the runs by means of spring force which acts on the double levers.

It goes without saying that the device is suitable for the arrangement of further drawing means which circulate in parallel.

It is significant for a reliable transport of the packages if the upper run or the upper runs of the drawing means and the opposite guide plate form a conveying gap/channel, in which the packages which are fed in are guided, It is advantageous if the upper run of the drawing means which interacts in each case with the guide plate forms a section which rises (slightly) in the conveying direction F and opens into a conveying gap/channel which serves for the precise guidance of the transported packages.

The running rollers of the conveying unit which are assigned to in each case one run are expediently mounted at the free end of a lever arm of the pivotable double levers and thus determine the position of the runs of the drawing means.

The lever arms of a double lever are preferably connected to one another at right angles or in a manner which differs therefrom, so as to form an acute angle, with the result that an optimum method of arrangement and operation between the runs is produced.

Within the context of economical production and spatial positioning, proves simple if the lever arms are of identically long configuration.

In order to tension the drawing means in the conveying unit, in particular their runs, it is advantageous if the running rollers bear jointly and uniformly against the inner side of a run by means of spring force, in a manner which tensions said run.

To this end, the drawing means have a full section of round cross section which is adapted to the running grooves of the deflecting rollers and is made from an elastic material such as rubber or a rubber mixture which is suitable for tensioning.

As a result, the runs of the drawing means can be held under tensile stress in the out-of-operation position and during operation with packages running through.

The running rollers which support the upper run form a conveying plane which is parallel to the transport plane and, in order to change the conveying gap/channel, is capable of being adapted to the thickness of the packages running through.

For this purpose, the cross-sectional height of the conveying gap/channel can be determined automatically by way of the thickness of a package which is fed in, under the action of a spring force on the double lever.

In order to conserve the conveying unit and the transported packages, the drawing means of the conveying apparatus are advantageously under tensile stress, under a constant spring force, both in the operating position and in the out-of-operation position of the conveying apparatus.

In order to form a transition region which has a conserving effect on the packages from the transfer table into the conveying gap/channel, the conveying circumferential region on the respective front running rollers in the conveying direction can be arranged above the conveying circumferential region of the upstream deflecting rollers, with the result that constant running of the packages onto the front section of the upper run can take place.

The deflecting rollers are preferably fastened to the parallel shafts which form the axles, are mounted in the machine frame and are arranged transversely with respect to the conveying direction F, at least one shaft being driven according to the transport speed of the packages.

An additional special significance for reliable functioning of the device consists in that the transverse bars which extend between the shafts of the deflecting rollers per se transversely with respect to the conveying direction F and are arranged next to one another in parallel are mounted double levers which can be pivoted in each case in pairs in a manner which is assigned to the drawing means or their runs, no additional space being used.

To this end, the transverse bars can be arranged in a plane which is defined by way of the shafts of the deflecting rollers of the drawing means, or can be fastened in the machine frame.

For the optimized available space utilization, in the out-of-operation position, the lever arms of a double lever can be oriented such that they are distributed approximately symmetrically (uniformly) to the plane which is defined by way of the transverse bars, with the result that, with the plane which is formed by way of the transverse bars, the lever arms of the double levers delimit an approximately identical angle toward the top and bottom, as a result of which an approximately uniform deflection/lifting of the runs toward the top or bottom takes place while the packages are running through.

It proves to be a simple embodiment if the springs, for example tension springs, which exert a uniform force on the double levers are connected in a clamped manner firstly to a lever arm of the double lever and secondly to a fastening element which is arranged approximately in the plane of the transverse bars.

In order to assist the drawing-in effect on the packages, the drawing means sections of two upper runs are in each case assigned a freely rotatable friction wheel which acts from above on the packages which are fed to the drawing means sections, which friction wheel acts to stabilize a regular transport of the packages.

To this end, the friction wheels can be set and adjusted for optimum gripping of the packages behind the end edge of the transfer table above the drawing means section in the conveying direction F.

For an optimum distribution of the packages to the printing unit, it can be arranged with the print head between two running roller pairs above the conveying unit.

In order to minimize the friction of the packages on the underside of the guide plate, the upper runs of the drawing means can be assigned beads or groove-like depressions which run in parallel in the conveying direction F in the guide plate, which beads or depressions result in a slight deformation and/or broader gripping of the packages on the facing surface of the drawing means, A further reduction of the friction on the underside of the guide plate can be achieved if supporting rails which run in parallel on both sides of the beads are fastened to the underside of the guide plate.

In the case of a device having an upstream transfer table, on which the packages are fed for printing to a printing unit such that they follow one another at spacings or part spacings, the transfer table which ends above the circumference of the deflecting rollers is advantageously configured by way of recesses, into which the drawing means engage with their front ends for disruption-free operation.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
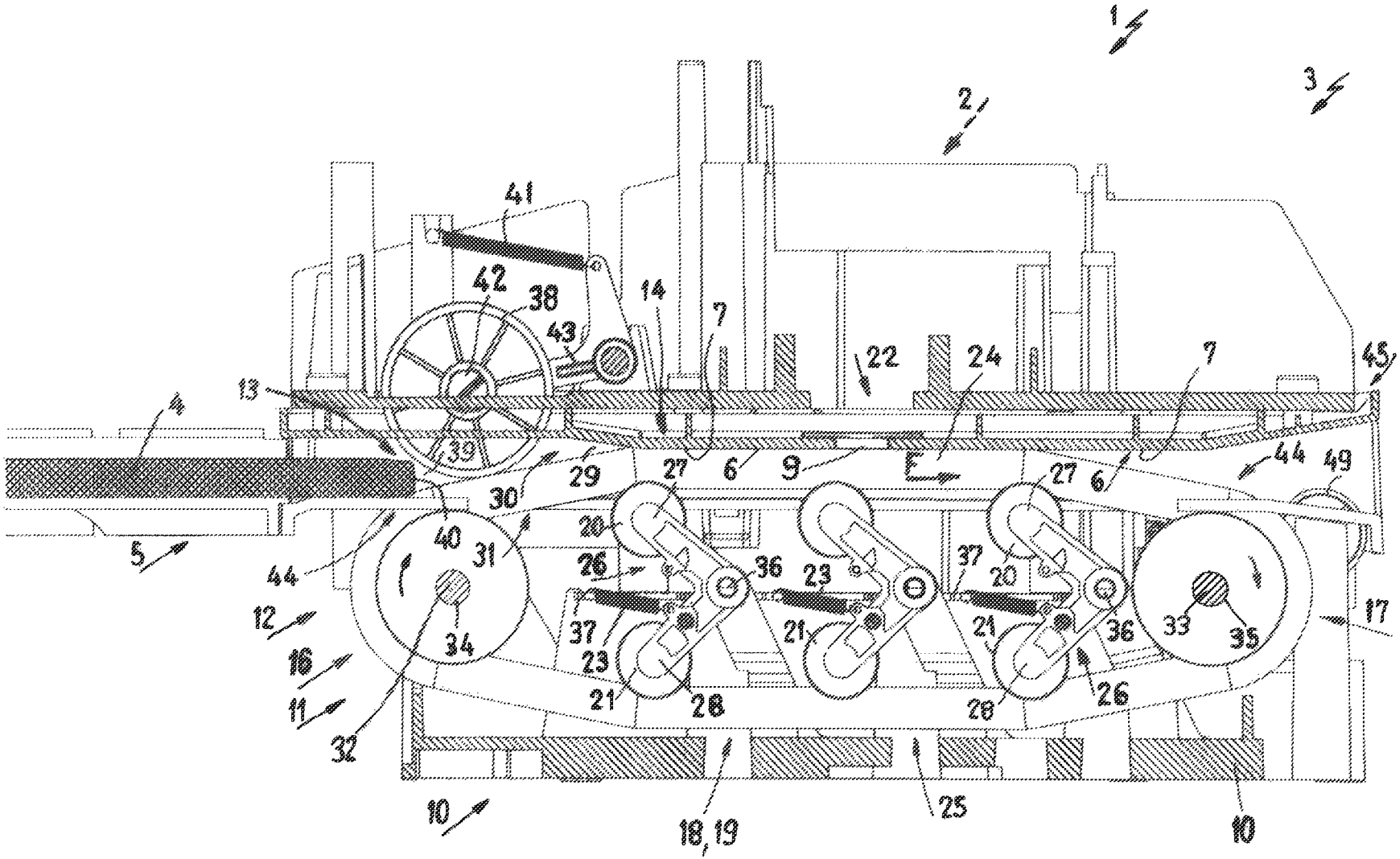
FIG. 1 shows a longitudinal section through the device according to the invention and through a printing unit of a franking machine during the feeding of a diagrammatically illustrated envelope as package.

FIGS. 1 to 4 show a device 1 for printing packages 4 which are fed individually to a printing unit 2 of a franking machine 3, such as envelopes, mailing bags, covers, printed products or the like, FIG. 1 shows a franking machine 3 directly during the feeding of a relatively thick package 4 into the printing unit 2. The packages 4 are fed to a printing unit 2 of the franking machine 3 by means of a transport apparatus via a transfer table 5 in the conveying direction F individually by hand or by an upstream separating apparatus (not visible) for packages 4 which are laid in a stacked manner.

As the figures show, a guide plate 6 is arranged on the underside of the printing unit 2 at least approximately over the width of the packages 4 which are fed in, which guide plate 6 forms a horizontal, upper transport plane 7 for the packages 4 which are fed in, and has an opening 9 for printing the packages 4 below a print head 8 of the printing unit 2. The guide plate 9 forms the horizontal transport plane 7, along which the packages 4 which arrive in each case at the conveying end of the transfer table 5 are gripped at the front end 13 by a conveying unit 11 of a conveying apparatus 12, are transported through below the printing unit 2 by said conveying unit 11, and, furthermore, leave the printing unit 2 along the transport plane. The conveying unit 11 and the conveying plane 7 bear against one another at a standstill and/or in the out-of-operation position of the printing unit 2; while the packages 4 are running through, a conveying part of the conveying unit 11 moves downward from the guide plate 9 or the conveying plane 7 in accordance with the thickness of the package 4. The guide plate 9 and the conveying unit 11 thus form a conveying gap or conveying channel 14 which extends at least approximately over the width of the conveying plane 7 and is delimited by way of a lateral guide 15 for positioning a package 4.

In order to aid the transport performance or conveying performance by way of drawing means 18, 19 and in order to reduce the friction of the packages 4 on the guide face of the guide plate 6, said guide face has, in the active region of the conveying runs 24, 25 of the drawing means 18, 19, beads 47 or groove-like depressions which are assigned to said runs 24, 25 in the conveying direction of the drawing means 18, 19, in which beads 47 or groove-like depressions the packages 4 are deformed appropriately by way of the drawing means 18, 19 onto the semicircular surface of the latter (in a manner which does not bear against the latter), in order to utilize the conveying action of the upper runs 24 of the drawing means 18, 19 in an optimum manner and in order for it to be possible to largely rule out the friction of the packages 4 on the large-area guide plate 6.

For the further reduction of the friction on the underside of the guide plate 6, projecting supporting rails 48 are fastened to said underside so as to run on o both sides next to the beads 47 and parallel to the latter, which supporting rails 48 hold the packages 4 at a slight spacing from the guide face of the guide plate 6, the drawing means 18, 19 being assigned, for example, in each case one supporting rail 48 on the inner side and in each case two supporting rails 48 which run in parallel on the outer side.

Both the printing unit 2 and the conveying apparatus 12 are connected fixedly to a machine frame 16 of the device 1.

The conveying unit 11 consists of at least two drawing means 18, 19 which circulate at a spacing next to one another about common horizontal axles on deflecting roller pairs 16, 17 which are spaced apart laterally in the conveying direction F, which drawing means 18, 19 form in each case one run 24, 25 along the conveying plane 7 and lying opposite the latter. The drawing means 18, 19 are preferably configured with a circular full cross section and consist of an elastic material such as rubber or a rubber mixture which exhibit a favorable coefficient of friction.

Accordingly, the deflecting rollers of the deflecting roller pairs 16, 17 have a groove or running groove on the circumference, which groove or running groove corresponds to the cross section of a circulating drawing means 18, 19.

The runs 24, 25 of the drawing means 18, 19 or the upper 24 and the lower run 25 are supported between the deflecting rollers on running or supporting rollers 20, 21 which are mounted freely rotatably in each case at the free ends of a pivotable double level 26 which is formed from lever arms 27, 28 which are connected in an angled-away manner, with the result that the upper runs 24 can be adjusted/moved downward or upward in each case jointly with the lower runs 25 in accordance with the thickness dimension of a package 4.

Both in the out-of-operation position and also in the case of packages 4 running through in the operating position, the running rollers 20, 21 of the conveying unit 11 support/guide the runs 24, 25 uniformly on a conveying section 22 of the upper runs 24 and of the non-conveying lower run 25 of the drawing means 18, 19, which conveying section 22 runs in parallel to the transport or guide plane 7.

Figure 2:
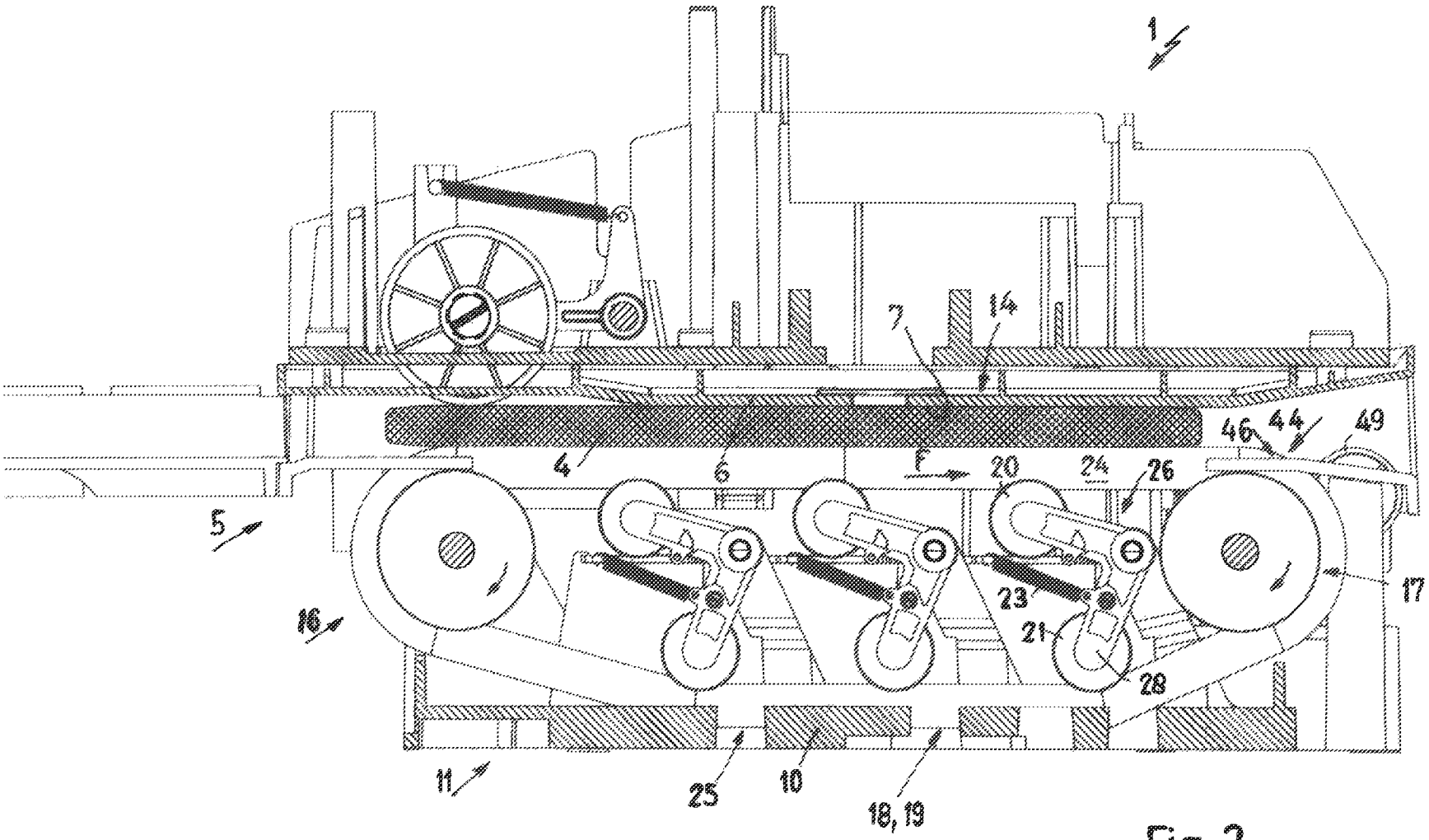
FIG. 2 shows an illustration of the device which is shown in FIG. 1 during the printing/franking of the envelope.

The running/supporting rollers 20 which act in a supporting manner on the conveying section 22 of the upper run 24 on the inner side are achieved by way of a spring force which is exerted on the double lever 26, for example by way of a tension spring 23 which is shown in FIGS. 1 and 2.

The upper running rollers 20 hold the upper run 24 in the region of the conveying section 22 against the guide plate 6 below the printing unit 2, with the is result that the conveying sections 44 of the runs 24 bear approximately against the guide plate 24 in the out-of-operation position.

As a result, an intake gap 29 or a channel inlet opening which tapers in the conveying direction F of the packages 4 is formed in the entry region of the conveying gap/channel 14, the cross-sectional height of which intake gap 29 or channel inlet opening is defined/opened, counter to the action of the force of the spring 23, by way of the thickness of a package 4 which is fed in.

At the same time, in the out-of-operation position of the printing unit 2 (see FIG. 1), the respective lower run 25 of the drawing means 18, 19 is situated in a position (upper end position) which is initiated via the assumed position of the double levers 26, and in which the upper and lower runs 24, 25 of the drawing means 18, 19 are not stretched on their entire length by way of the drawing means sections 31 which are formed at the ends of the runs 24, 25, but the channel inlet opening 29 becomes accessible only by way of a package 4 which arrives from the transfer table 5. The cross-sectional height of the conveying gap/channel 14 is defined by way of the thickness of the packages 4 which are fed in, under the action of the spring force from the spring 23 on the double levers 26.

The device o distinguished, inter alia, by the fact that permanent tensioning of the drawing means 18, 19 is ensured by way of the adjustable runs 24, 25 of said drawing means 18, 19 both when out of operation and during operation of the present conveying unit 11.

As viewed in the conveying direction F, the inlet region upstream of the conveying gap/channel 14 has a running roller 20, which is higher than the front deflecting roller 16, and following running rollers 20, with the result that, as viewed in the conveying direction F, a rising and conveying drawing means section 31 which is formed by way of the upper run is produced, the gradient of which drawing means section 14 changes in sync with the feeding by way of the packages 4 of different thickness.

Thicker or thinner packages 4 which are fed in a synchronized manner change the inclination of the gradient of the drawing means sections 31 which act in the feed region and the cross-sectional height of the conveying gap or conveying channel 14 and/or the position of the runs 24, 25.

The length of the conveying gap/channel 14 conforms to the thickness of a package 4.

The drawing means 18, 19 are held under constant tensile stress by way of the double levers 26 which form in each case one drawing means tensioning unit and are loaded permanently with spring force, and the running/supporting rollers 20, 21 which bear against the inner side of the runs 24, 25 of a drawing means 18, 19, The conveying unit 11 (drawing means tensioning unit) which is formed from common axles 32, 33 for the deflecting rollers 16, 17 of the drawing means 18, 19, which common axles 32, 33 are oriented transversely with respect to the movement direction F of the packages 4, is arranged in the machine frame 10 of the franking machine 3, for example in a lower part of a machine stand, below the printing unit 2.

The deflecting rollers 16, 17 are fastened to the driven shafts 34, 35 which form the axles 32, 33, are mounted in the machine frame 10, and of which one shaft 34 or 35 is driven.

The double levers 26 are mounted such that they can be pivoted in pairs and are assigned to the drawing means 18, 19 or theft runs 24, 25 by transverse bars 36 which form parallel bearings between the axles 32, 33 or shafts 34, 35 of the deflecting rollers 16, 17 and at spacings from one another.

The transverse bars 36 are preferably fastened in the machine frame 10 and/or arranged in a (horizontal) plane which is formed by way of the axles 32, 33 of the deflecting rollers 16, 17 of the drawing means 18, 19.

Figure 3:
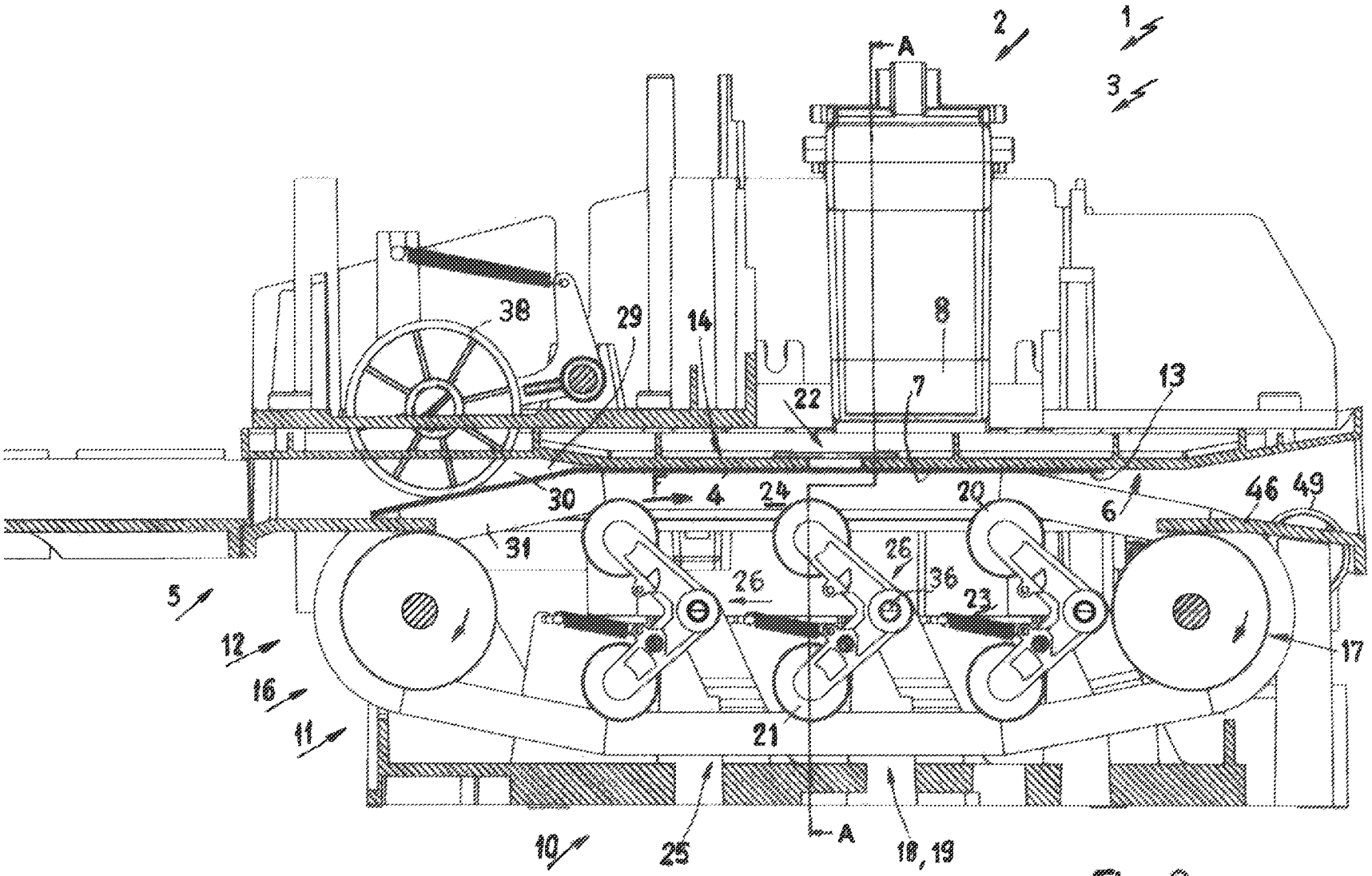
FIG. 3 shows an illustration of the device which is shown in FIGS. 1 and 2 during the printing/franking of a thin package.
Figure 4:
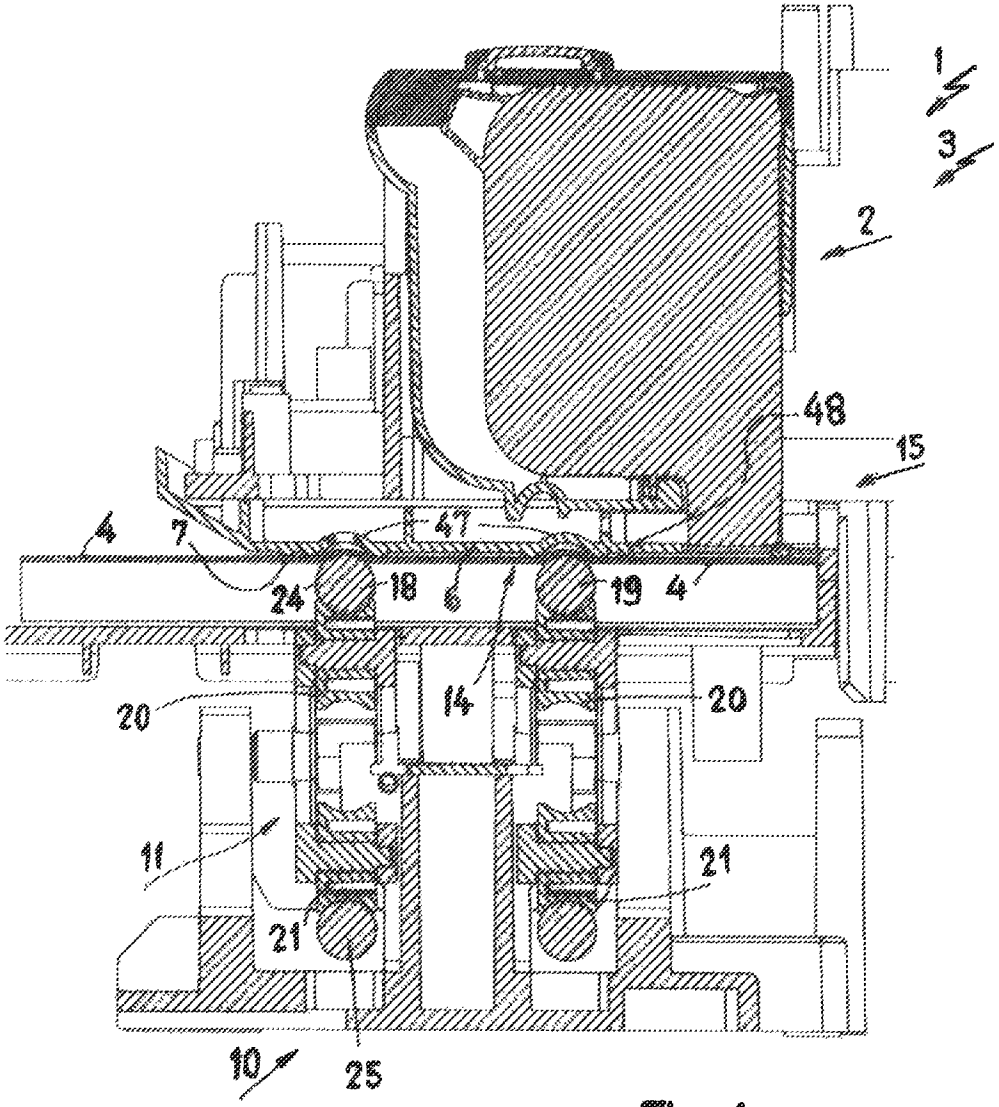
FIG. 4 shows a cross section through the device according to the line A-A in FIG. 3.

The equally long lever arms 27, 28 which in each case make up a double lever 26 are connected to one another at an angle of approximately 90° according to FIGS. 1 to 3.

In the out-of-operation position, in which the conveying runs 24 move closer to the guide plate 6, the lever arms 27, 28 of a pivotable double lever 26 are oriented such that they are distributed approximately symmetrically onto the plane of the transverse bars 36, and change the position, in the case of a package 4 which is transported through the printing unit 2, on account of its thickness which acts on the upper run 24, as shown in FIG. 2.

The springs 23 which exert a spring force are clamped at one end, at an end which faces the double lever 26, to one of the lever arms 27, 28 of the double levers 26 and at the other end, by way of the end which faces away therefrom, on a fastening element 37 which is arranged in approximately the plane of the transverse bars 36.

In the region of the intake sections 30 of the upper runs 24, the drawing means sections 31 are assigned in each case one friction wheel or intake wheel 38 which forms an intake gap 39 with the run 24 and is loaded by a spring force.

A package 4 which arrives at the intake section 30 is first of all received at the front edge 40 into the intake gap 39 which is formed in each case by way of the intake sections 30 and friction wheels 38, and is transported further in a conveying manner by way of said formed unit, it being possible for the friction wheels 38 to be driven freely rotatably or in the same way as the speed of the drawing means 18, 19, and said friction wheels 38 being pressed onto the packages 4 at the intake section 30 by way of springs 41. To this end, the friction wheels 38 are fastened to a common shaft 42 which is positioned transversely with respect to the conveying direction F and is arranged pivotably on levers 43 which are loaded by way of springs 41. The transfer table 5 which ends approximately above the circumference of the deflecting roller pair 16 in the conveying direction F is configured by way of recesses 44 which are assigned to the drawing means 18, 19, with the result that a shallowly rising angle is produced for the transported packages 4 at the transfer point between the transfer table 5 and the intake gap 39.

The same structural measure is provided at the transition to the deliverer 45 downstream of the printing unit 2, where a guide element 46 which is provided with slot-like recesses 44 and an ejector roller 49 which is driven about a downstream axle transversely with respect to the conveying direction F pick up the printed packages 4 from the drawing means 18, 19 and guide them further.

While specific embodiments of the invention have been shown and described in detail to illustrate the inventive principles, it will be understood that the invention may be embodied otherwise without departing from such principles.

I claim:

1. A device for printing flat packages fed individually to a printing unit of a franking machine, pass the printing unit on at least one side in a manner which is driven in a frictionally locking manner, and are guided on a side edge in a conveying direction, comprising:

a conveying apparatus that grips the packages at a front end in the conveying direction, the conveying apparatus including a conveying unit; and a guide plate arranged on an underside of the printing unit so as to form a conveying plane of a conveying gap/channel with the conveying unit of the conveying apparatus, wherein, as viewed in the conveying direction of the packages, the conveying unit has at least two endless drawing means next to and spaced from each other, each of the two endless drawing means circulates a common axle on deflecting rollers, an upper run of the drawing means, which faces the guide plate, and a lower run of the drawing means are guided on running rollers mounted freely rotatably in pairs so as to lie opposite one another at pivotable ends of one of a plurality of double levers of the conveying unit, which pivotable ends are assigned to the upper run and the lower run, respectively, of the drawing means and are formed by angled-away lever arms of the double levers, the pivotable ends being supported on an inner side of the runs by spring force that acts on the double levers, wherein the running rollers that support the upper run form a conveying plane that is parallel to the transport plane, and wherein the conveying gap/channel has a cross-sectional height that is determined by a thickness of a package which is fed in, under action of a spring force on the double lever, wherein the drawing means have an approximately circular cross section made from an elastic material.

2. The device according to claim 1, wherein the upper runs of the drawing means which form a conveying gap/channel with the guide plate have a section that rises in the conveying direction and a section that falls at a conveying gap/channel end.

3. The device according to claim 2, further comprising a freely rotatable friction wheel assigned to each drawing means section in a region of an intake section of the upper runs so that the freely rotatable friction wheel acts from above on the packages which are fed in.

4. The device according to claim 1, wherein the lever arms form substantially a right angle.

5. The device according to claim 1, wherein a conveying circumferential region of a front-most, in the conveying direction, of the running rollers of the conveying unit is arranged above a conveying circumferential region of upstream of the deflecting rollers to form a rising section of the drawing means.

6. The device according to claim 1, further comprising a machine frame, wherein the deflecting rollers are fastened to shafts that form axles and are mounted in the machine frame, at least one of the shafts being driven.

7. The device according to claim 1, further comprising transverse bars on which the double levers are mounted, wherein, in the out-of-operation position of the printing unit, the lever arms of each double lever are oriented such that they are distributed approximately symmetrically to a plane defined by the transverse bars.

8. The device according to claim 7, further comprising springs which exert the spring force on the double levers, the springs being clamped firstly to one of the lever arms of the double lever and secondly to a fastening element arranged in the plane of the transverse bars.

9. The device according to claim 1, wherein the upper run and the opposite guide plate form the conveying gap/channel.

10. The device according to claim 1, wherein the lever arms of the double levers are connected to one another so as to form an acute angle.

11. A device for printing flat packages fed individually to a printing unit of a franking machine, pass the printing unit on at least one side in a manner which is driven in a frictionally locking manner, and are guided on a side edge in a conveying direction, comprising:

a conveying apparatus that grips the packages at a front end in the conveying direction, the conveying apparatus including a conveying unit; and a guide plate arranged on an underside of the printing unit so as to form a conveying plane of a conveying gap/channel with the conveying unit of the conveying apparatus, wherein, as viewed in the conveying direction of the packages, the conveying unit has at least two endless drawing means next to and spaced from each other, each of the two endless drawing means circulates a common axle on deflecting rollers, an upper run of the drawing means, which faces the guide plate, and a lower run of the drawing means are guided on running rollers mounted freely rotatably in pairs so as to lie opposite one another at pivotable ends of one of a plurality of double levers of the conveying unit, which pivotable ends are assigned to the upper run and the lower run, respectively, of the drawing means and are formed by angled-away lever arms of the double levers, the pivotable ends being supported on an inner side of the runs by spring force that acts on the double levers, wherein an underside of the guide plate has beads that are assigned to the upper runs of the drawing means and run parallel in the conveying direction.

12. The device according to claim 11, further comprising support rails fastened to the underside of the guide plate so as to run parallel on both sides of the beads.

13. The device according to claim 11, wherein the running rollers that support the upper run form a conveying plane that is parallel to the transport plane.

14. The device according to claim 11, wherein the conveying gap/channel has a cross-sectional height that is determined by a thickness of a package which is fed in, under action of a spring force on the double lever.

15. The device according to claim 14, wherein the drawing means and the runs of the conveying apparatus are tensioned by way of the spring force both in an operating position and in an out-of-operation position.

* * * * *